United States Patent [19]

Sakurai

[11] Patent Number: 4,537,109

[45] Date of Patent: Aug. 27, 1985

[54] DISH WITH A MELODY SOUNDING FUNCTION

[75] Inventor: Koichi Sakurai, Tara, Japan

[73] Assignee: Sakuraya Corporation, Tara, Japan

[21] Appl. No.: 570,906

[22] Filed: Jan. 16, 1984

[51] Int. Cl.[3] ..... G10F 1/00

[52] U.S. Cl. ..... 84/1.03; 84/1.18; 84/DIG. 19

[58] Field of Search ..... 250/215; 84/1.18, DIG. 19, 84/1.03; 446/175; D7/45

[56] References Cited

U.S. PATENT DOCUMENTS

| | | | |
|---|---|---|---|
| 3,378,680 | 4/1968 | Moxley | D7/45 |
| 3,930,249 | 12/1975 | Steck et al. | 250/215 |
| 4,336,574 | 6/1982 | Goodman | D7/45 |

OTHER PUBLICATIONS

"IC Doorbell Plays Your Song", Radio-Electronics, Sep. 1975 and Oct. 1975.

*Primary Examiner*—Forester W. Isen

[57] ABSTRACT

A dish for supporting a light blocking object such as a coffee cup, a tea cup or the like, having a melody sounding function is disclosed, in which the dish below its object supporting surface is provided with a melody sounding means proximate to the object supporting surface for producing and playing a given melody for a predetermined time by means of a switching mechanism including a photosensor. The melody is automatically produced on removing the object from the dish and exposing the photosensor of a melody sounding means to the light passing through the dish of light permeable material.

4 Claims, 4 Drawing Figures

DISH WITH A MELODY SOUNDING FUNCTION

FIELD OF THE INVENTION

This invention relates to a light permeable dish which supports a light blocking object such as a coffee cup. It relates more particularly to a dish capable of producing a melody for a predetermined time under control of a photosensor switching means automatically operated when the light blocking object is removed from the dish.

BACKGROUND OF THE INVENTION

Toys and electric appliances are known which on detecting electrical, light and/or sound signals actuate a switch thereby to energize various acoustic devices. Such conventional devices require special means for generating the electrical, light and/or sound signals to operate the acoustic devices.

An object of the invention therefore is to provide a dish adapted with a melody producing means which can automatically be operated without need for a special operating means.

SUMMARY OF THE INVENTION

With the foregoing in mind, I provide in accordance with the invention a dish having a melody sounding function, wherein the dish is adapted to receive a light blocking object on an object supporting surface thereof, said object supporting surface being light permeable, a melody sounding means supported below the object supporting surface of the dish in proximate relation thereto for producing a melody for a predetermined time, and means forming part of the melody sounding means and comprising a photosensor for initiating production of a melody when said photosensor is impinged by light as occurs when the dish is free of the light blocking object.

PREFERRED EMBODIMENTS OF THE INVENTION

The invention is described below for illustrative purposes with reference to the accompanying drawings.

Figure 1:
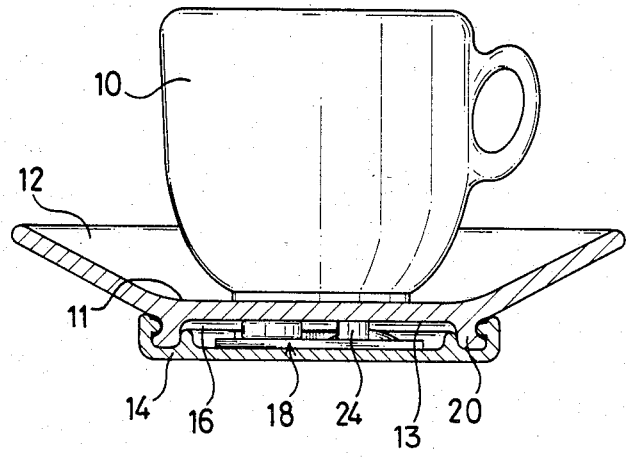
FIG. 1 is a sectional view of the dish according to the invention, a cup being shown on the object supporting surface of the dish.
Figure 2:
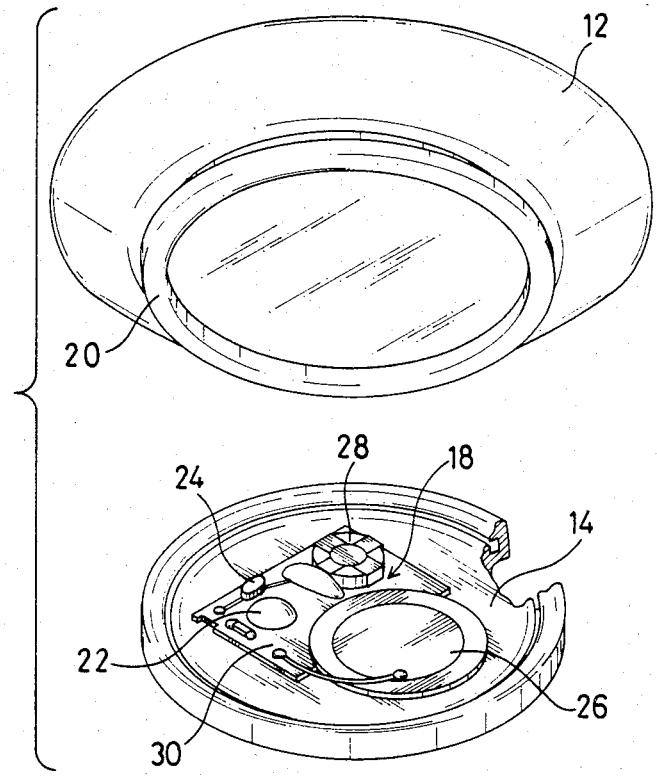
FIG. 2 is a perspective view of the dish shown in FIG. 1 and also shows the melody playing means prior to its assembly to the dish.

FIGS. 1 and 2 show one embodiment of the dish according to the invention, in which reference 10 represents an object, such as a cup, supported on an object supporting surface 11 of a dish 12. The dish 12 below its bottom face 13 is removably provided with a receiving plate 14, so formed as to define with the dish bottom face a space 16 in which is housed a melody sounding means 18. The dish 12 is formed of a light-permeable porcelain or of a synthetic plastic. A bottom head 20 of the dish 12 is sealingly fitted into a peripheral edge of the receiving plate 14.

Figure 4:
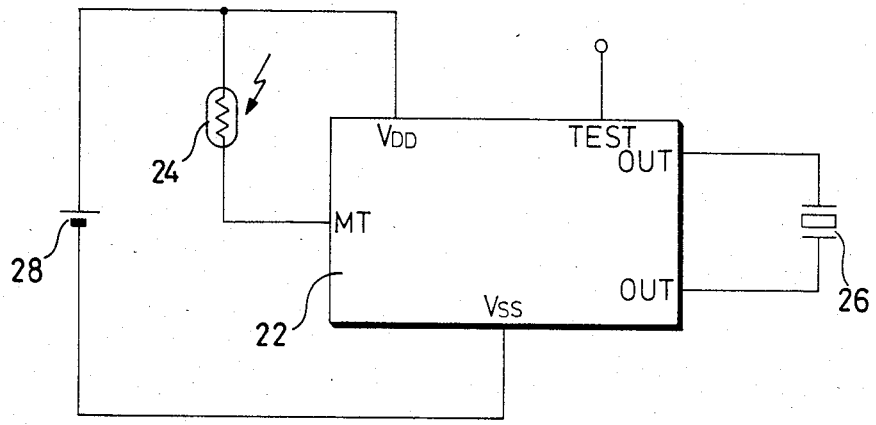
FIG. 4 shows a block diagram of the various components of the melody sounding means forming part of the dish according to the invention.

The melody sounding means 18 incorporates an integrated circuit 22, hereinafter referred to as a melody IC, a photosensor 24, a speaker 26 and a power battery 28, all as shown in FIG. 4. These elements are in electrical connection with each other and for the most part carried on a compact base plate 30. Any commercially available melody IC 22 may be used which has a stored preprogrammed melody. The photosensor 24 may be a cadmium sulfide (CdS) semiconductor photoelement. The photosensor 24 is arranged in the space 16 below the bottom face 13 of the dish 12, the object supporting surface 11 on receiving cup 10 being blocked from light communication with photosensor 24. For this purpose, cup 10 may be made either of a light permeable or a light blocking material. If made of a light permeable material, a beverage within the cup will block light from reaching the photosensor. Accordingly, when the cup 10 is removed from dish 12, light will pass through the dish 12 onto the photosensor 24. The speaker 26 may be formed of a piezoelectric semi-conductor element while for the battery 28 there is preferably used a mercury cell.

Figure 3:
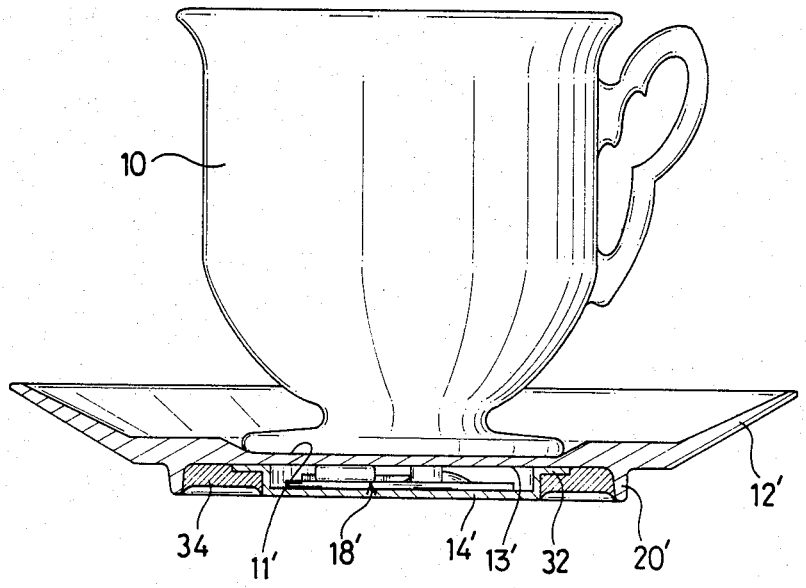
FIG. 3 is a sectional view of another embodiment of the dish according to the invention, a cup being shown on the object supporting surface of the dish.

FIG. 3 shows another embodiment of the dish according to the invention, in which like parts have been assigned the same reference numerals but with the prime mark designations added. In FIG. 3 the receiving plate 14' is formed as a case which carries the melody sounding means 18'. The peripheral edge of the plate 14' is provided with an outward flange 32 which engages the bottom face 13' of the dish 12', a groove being formed between the periphery of the plate 14', including the flange 32 and the bottom bead 20' of the dish 12', an adhesive 34 being provided in the groove of, for example, a silicone resin adhesive for fixing plate 14' to the dish.

It will be appreciated that the receiving plate 14' is not limited to the structure described but may take other forms so long as it can be fixed to the bottom face of the dish 12'.

The dish according to the invention will now operationally be described with reference to the melody sounding means 18, shown in block diagram form in FIG. 4, which may be used with the dish of FIGS. 1 and 2 or FIG. 3.

FIG. 4 shows a block diagram of the various elements of the melody sounding means which, as noted, may be used in conjunction with the dish of FIGS. 1 and 2 or FIG. 3. In FIG. 4, the reference characters used are the same as in FIG. 2 for the same elements.

A suitable melody IC 22 for use in the melody sounding means is a SVM 7903 "melody IC" commercially available from SEIKOSHA K.K. in Japan. Across the input terminals $V_{DD}$–$V_{SS}$ of the melody IC 22 is connected a mercury cell 28 with its polarity as shown in FIG. 4. Further, between the positive terminal of the mercury cell 28 and signal input terminal MT of the melody IC 22 is connected a CdS semiconductor photoelement as the photosensor 24. Between output terminals (OUT-OUT) of the melody IC 22 is connected the speaker 26 preferably comprising a piezoelectric semiconductor element, such as a EFB-S46C42 piezoelectric device commercially available from Matsushita Electric Industrial K.K. in Japan.

When the photosensor 24 of the melody sounding means 18, with the described connections, is exposed to light passing through the light-permeable dish 12 (as cup 10 is removed from the dish 12), it will supply an input signal to the input terminal MT of the melody IC 22. This input signal makes operational the described melody sounding circuit through a switching circuit, such as one shot multi-vibrator, incorporated into the melody IC 22, thereby to produce a preprogrammed melody through the speaker 26 for a predetermined time. If a melody is to be repeated, the photosensor 24 may deliberately be blocked from light reception, thus resetting the melody providing means 18, and then again exposed to light to provide the necessary input signal to the input terminal MT of the melody IC 22.

It will be appreciated from the hereinabove described embodiments that the dish according to the invention may comprise a dish for a coffee cup, a tea cup and the like, and that removal of the cup from the dish as when drinking coffee or tea will automatically produce a melody resulting in a very amusing and useful tableware.

Furthermore, the melody IC may store a plurality of different optionally selectable melodies enhancing thereby the pleasure in consuming a beverage.

The receiving plate 14 or 14' according to the invention may be applied to any existing light permeable dish by mounting the plate to be carried thereby, sealingly to the dish without any special tools and thus may be utilized in a wide range of applications, at low cost.

In addition, the melody sounding means of the invention may be arranged in well known manner to play for a predetermined period of time stored melodies with a single input signal, thus considerably reducing power consumption so that 3,000–4,000 melodies may be produced with one commercial mercury cell.

While preferred embodiments of the invention have been disclosed, it will be apparent to one skilled in the art that many variations and modifications may be made without departing from the scope and spirit of the invention defined by the appendant claims.

What I claim is:

1. A dish having a melody sounding function and comprising a bottom wall of predetermined thickness and an annular wall outwardly flared from the bottom wall, at least said bottom wall for its entire extent being light permeable throughout its thickness and having an upper surface adapted to receive a light blocking object, a melody sounding means supported below said bottom wall of the dish in proximate relation to said bottom wall for producing a melody for a predetermined time, means for thus supporting the melody sounding means, and means forming part of the melody sounding means and comprising a photosensor normally exposed to light through the light permeable bottom wall of the dish for initiating production of a melody when said photosensor is impinged by light as occurs when the dish is free of the light blocking object, said melody supporting means comprising a plate mounted to the dish in relation to its bottom wall to define a space between the plate and the bottom wall in which space said melody sounding means is received.

2. The dish of claim 1, wherein said plate has adjacent its outer periphery at least one annular upstanding part adapted for sealing engagement with an annular downwardly extending outer peripheral part of the dish whereby to achieve said mounting of the plate to the dish.

3. The dish of claim 2, wherein the one upstanding part of the plate and the annular outer peripheral part of the dish define a groove in which an adhesive is provided for sealing the plate to the dish.

4. The dish according to claim 2, wherein the plate is formed with a second annular upstanding part outwardly of the first part so as to define a space therebetween into which said downwardly extending part of the dish is sealingly fitted between said one and said second part of said plate.

* * * * *